US007628400B2

(12) United States Patent
Ishikawa

(10) Patent No.: US 7,628,400 B2
(45) Date of Patent: Dec. 8, 2009

(54) CONVEYING APPARATUS

(75) Inventor: Kan Ishikawa, Toyoake (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 512 days.

(21) Appl. No.: 11/512,592

(22) Filed: Aug. 30, 2006

(65) Prior Publication Data

US 2007/0045086 A1 Mar. 1, 2007

(30) Foreign Application Priority Data

Aug. 31, 2005 (JP) ..... 2005-251776

(51) Int. Cl.
*B65H 5/34* (2006.01)

(52) U.S. Cl. ..... 271/270; 271/261; 271/275; 271/258.01

(58) Field of Classification Search ..... 271/202, 271/258.01, 259, 261, 270, 275
See application file for complete search history.

(56) References Cited

U.S. PATENT DOCUMENTS 4,733,269 A * 3/1988 Kasahara et al. ..... 399/301
5,105,363 A * 4/1992 Dragon et al. ..... 700/225
5,114,306 A * 5/1992 Sjogren et al. ..... 414/790.4
6,301,451 B1 * 10/2001 Ando et al. ..... 399/38
6,322,069 B1 * 11/2001 Krucinski et al. ..... 271/265.02
6,371,021 B1 * 4/2002 Rombult ..... 101/232
6,494,447 B2 * 12/2002 Myer, Sr. ..... 271/176
6,779,791 B2 * 8/2004 Kawamura et al. ..... 271/228
7,078,875 B2 * 7/2006 Shoji et al. ..... 318/626
7,156,391 B2 * 1/2007 Okamoto et al. ..... 271/258.01
7,398,047 B2 * 7/2008 Krucinski et al. ..... 399/394
2005/0093490 A1 5/2005 Shoji et al.

FOREIGN PATENT DOCUMENTS

JP 2005-15227 1/2005
JP 2005-132029 5/2005
WO WO 2004/108419 12/2004

* cited by examiner

*Primary Examiner*—Douglas A Hess
(74) *Attorney, Agent, or Firm*—Reed Smith LLP

(57) ABSTRACT

A conveying apparatus includes a conveyor roller, an angular velocity detection device, and a rotation angle calculation device. The conveyor roller conveys a conveyance object by a rotation thereof. The angular velocity detection device is provided to one of the conveyor roller and a rotating portion rotating with the conveyor roller such that an angular velocity detection axis is parallel with a rotation shaft of the conveyor roller. The rotation angle calculation device calculates a rotation angle of the conveyor roller based on an angular velocity detected by the angular velocity detection device.

12 Claims, 7 Drawing Sheets

CONVEYING APPARATUS

CROSS-REFERENCE TO RELATED APPLICATIONS

This application claims the benefit of Japanese Patent Application No. 2005-251776 filed Aug. 31, 2005 in the Japanese Patent Office, the disclosure of which is incorporated herein by reference.

BACKGROUND

The present invention relates to a conveying apparatus for conveying a conveyance object by a rotation of a conveyor roller.

In a conventional image forming apparatus, such as an inkjet printer, a conveyor roller is used to convey a recording sheet or the like as a recording medium. Such a conveyor roller is equipped with a rotary encoder to detect a rotation angle of the conveyor roller such that a feed amount and a conveyance position of the recording medium can be controlled in accordance with the rotation of the conveyor roller.

The rotary encoder usually includes a code wheel (a disk) and an optical sensor. The code wheel having slits formed at approximately equal intervals along a circumferential direction is fixed to a rotation shaft of the conveyor roller. The optical sensor detects passage of the slits caused by a rotation of the code wheel.

According to the above configuration, a pulse signal is output from the rotary encoder by each specified rotation angle of the conveyor roller. By measuring a generation interval (time interval) of the pulse signals, a rotation speed of the conveyor roller can be detected. By counting a number of the pulse signals, a rotation angle of the conveyor roller can be determined.

To improve a resolution of a conveyance amount which is controllable by the pulse signals from the rotary encoder, a pulse number to be output from the rotary encoder per rotation of the conveyor roller should be increased. This may be achieved by reducing slit intervals of the code wheel or increasing a diameter of the code wheel, thereby to increase a number of the slits to be formed in the code wheel.

SUMMARY

However, reducing slit intervals of the code wheel leads to a problem that the optical sensor cannot detect passage of the slits accurately due to an influence of dust, and thus a detection accuracy of the rotation angle is lowered. Especially in an inkjet printer, in which generation of ink mist and paper powder is likely, the above problem caused by reducing slit intervals of the code wheel is significant.

On the other hand, in the case of increasing the diameter of the code wheel, the above problem may be avoided since the number of slits can be increased without reducing slit intervals. However, there may be another problem. Specifically, a size of the entire rotary encoder will be larger, and thus a size of the entire conveying apparatus, including the conveyor roller, should be larger. Such a rotary encoder with a larger size may not be employed in an apparatus to be portable, such as an image forming apparatus.

In other words, the possibility of obtaining a higher resolution of the conveyance amount controllable by improving the rotary encoder may be limited.

One aspect of the present invention may provide a conveying apparatus which may achieve a higher resolution of a controllable conveyance amount without a growth in size of the conveying apparatus, and which can always control the conveyance amount highly accurately without being affected by dust, such as ink mist or paper powder.

In the one aspect of the present invention, there is provided a conveying apparatus which includes a conveyor roller, an angular velocity detection device, and a rotation angle calculation device. The conveyor roller conveys a conveyance object by a rotation thereof. The angular velocity detection device is provided to one of the conveyor roller and a rotating portion rotating with the conveyor roller such that an angular velocity detection axis is parallel with a rotation shaft of the conveyor roller. The rotation angle calculation device calculates a rotation angle of the conveyor roller based on an angular velocity detected by the angular velocity detection device.

In the conveying apparatus of the present invention, the angular velocity detection device is used instead of a rotary encoder as in a conventional conveying apparatus in order to detect the rotation angle of the controller. The angular velocity detection device may be one of a mechanical gyro sensor, an optical gyro sensor, a fluidic gyro sensor and a vibratory gyro sensor. Each of these gyro sensors continuously outputs an analog signal corresponding to an angular velocity. Accordingly, a resolution of a rotation angle obtained by integrating the angular velocity by the rotation angle calculation device will be significantly higher than a resolution of a rotation angle detected by a rotary encoder, and can be infinitely improved in theory.

It may, therefore, be possible to control a transfer amount and a conveyance position of the conveyance object highly accurately by controlling a conveyance amount of the conveyance object based on the rotation angle of the conveyor roller calculated by the rotation angle calculation device.

Also, there is no relationship between a size of the gyro sensor and the resolution of the rotation angle obtained by the rotation angle calculation device. Accordingly, the size of the gyro sensor needs not be increased to achieve an improved resolution of detectable rotation angles It may, therefore, be possible to achieve downsizing of a conveying apparatus capable of conveying a conveyance object in a highly accurate manner, according to the present invention.

Further, the gyro sensor to be used as the angular velocity detection device is usually housed in a housing, and thus may detect the angular velocity without being affected by fouling by dust or the like, unlike the case of a rotary encoder.

According to the conveying apparatus of the present invention, therefore, it may be possible to convey the conveyance object in a highly accurate manner even in a case of using the conveying apparatus in an environment in which fouling is likely to occur. For example, when the conveying apparatus of the present invention is used as a paper feed apparatus in an inkjet printer in which ink mist or paper powder is likely to be generated, it may be possible to control a conveyance position of a recording sheet in a highly accurate manner, thereby to form a clear image on the recording sheet.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

Figure 1:
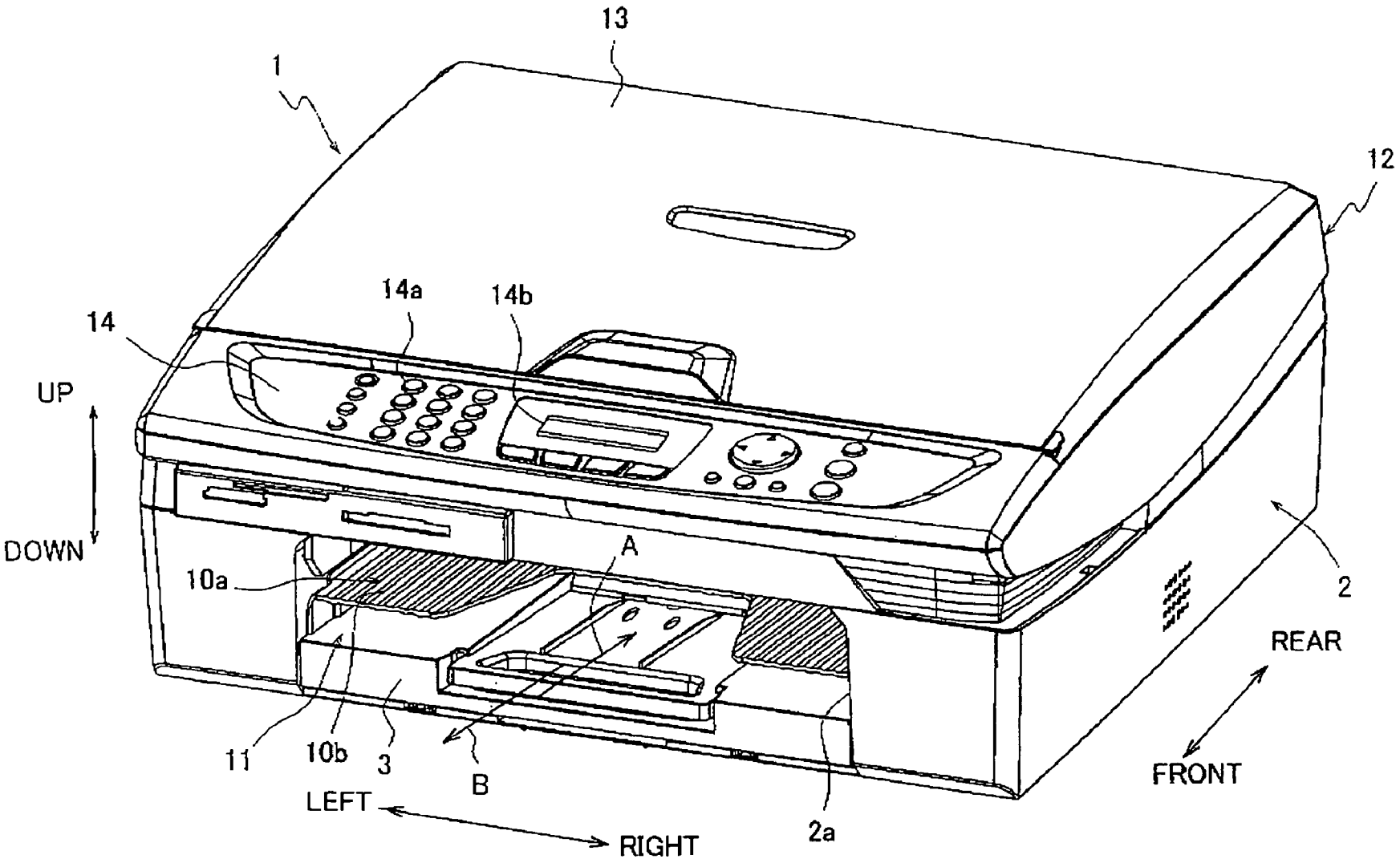
FIG. 1 is a perspective view of a multi-function device of the present embodiment.
Figure 2:
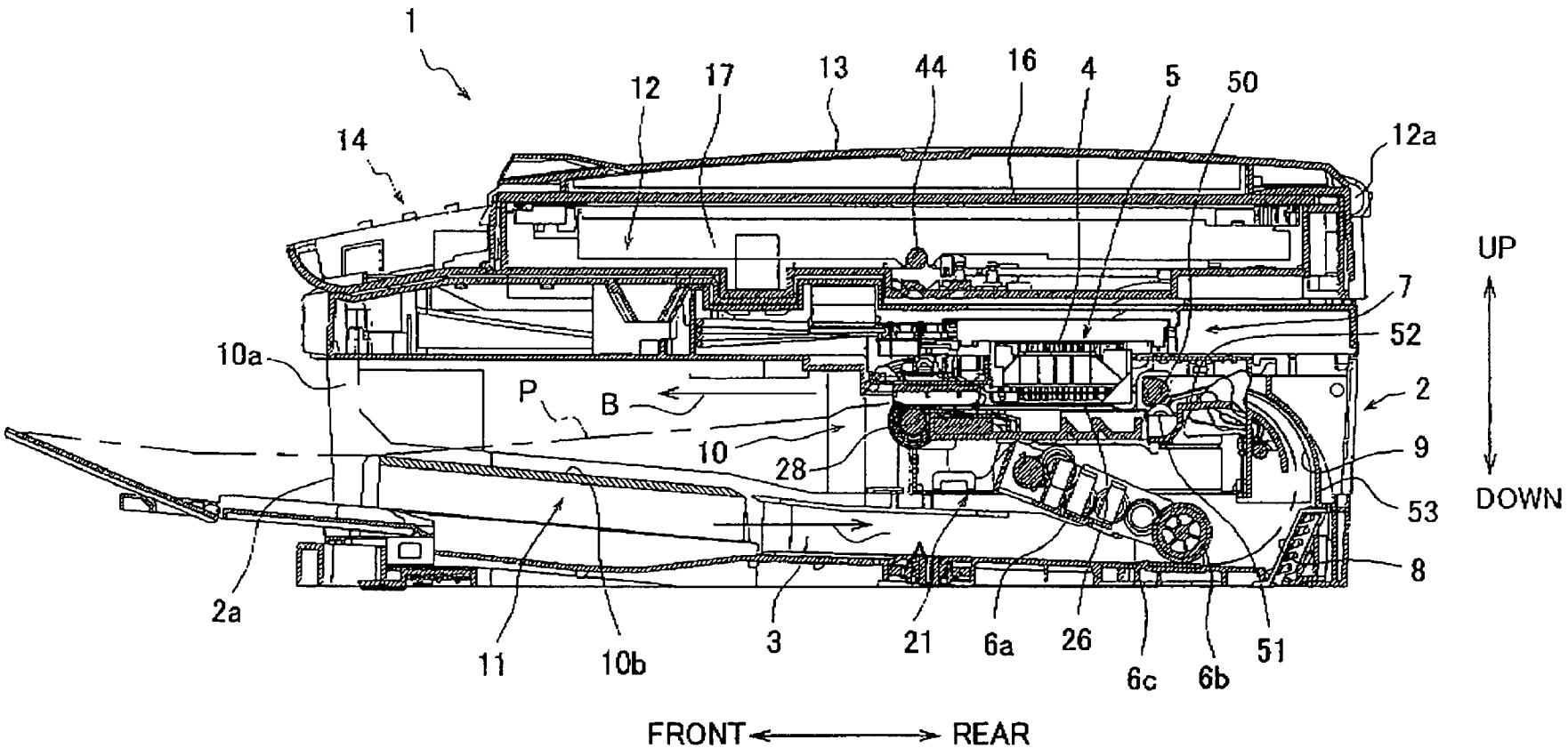
FIG. 2 is a cross-sectional side elevation view of the multi-function device of the present embodiment.

A multi-function device (MFD: Multi-Function Device) 1 is an apparatus provided with a printer function, a copier function, a scanner function and a facsimile function. As shown in FIG. 1 and FIG. 2, the multi-function device 1 includes a housing 2 made of synthetic resin and an image scanner 12 for document scanning disposed on the housing 2.

The image scanner 12 is configured so as to be pivotable upwardly and downwardly in an opening and closing manner with respect to the housing 2 around a not-shown axis provided at a left end (in FIG. 2) of the image scanner 12. Also, a document cover 13 to cover all over the top surface of the image scanner 12 is attached so as to be pivotable upwardly and downwardly in an opening and closing manner around an axis 12*a* (see FIG. 2) provided at a rear end of the document cover 13.

As shown in FIG. 2, a placement glass plate 16 to place a document thereon after upwardly opening the document cover 13 is provided on an upper surface of the image scanner 12. A contact image sensor (CIS: Contact Image Sensor) 17 for document scanning is provided under the placement glass plate 16. The contact image sensor 17 is reciprocable along a guide shaft 44 extending in a direction perpendicular to a paper surface in FIG. 2 (i.e., a main scanning direction, a right and left direction).

An operation panel 14 is disposed in a front portion of the image scanner 12. The operation panel 14 includes operation buttons 14*a* for performing input operations and a liquid crystal display (LCD) 14*b* for displaying a variety of information.

A sheet feed unit 11 for feeding a recording sheet P as a recording medium (a conveyance object) is disposed in a bottom portion of the housing 2. The sheet feed unit 11 includes a sheet feed cassette 3, which is attachable and detachable in a front and rear direction of the housing 2 through an opening 2*a* formed in a front portion of the housing 2. The sheet feed cassette 3 in the present embodiment is configured so as to contain a plurality of sheets P cut into, for example, A4 size, letter size, legal size, postcard size, etc. and loaded (stacked) in an orientation such that a shorter side (a width) of the recording sheet P extends in a direction (a main scanning direction, a right and left direction) perpendicular to a sheet feed direction (i.e., a sub scanning direction, a front and rear direction, a direction of arrow A).

As shown in FIG. 2, a slant separation plate 8 for separating recording sheets is disposed at a back (on a rear end side) of the sheet feed cassette 3. The slant separation plate 8 is configured to be convexly curved, when seen in a plan view, such that the slant separation plate 8 protrudes in a central portion thereof in a width direction of the recording sheet P and retreats toward right and left ends thereof in the width direction of the recording sheet P. A sawtooth-like elastic separation pad, which abuts a front edge of the recording sheet P thereby to urge separation, is provided in the central portion of the slant separation plate 8 in the width direction of the recording sheet P.

In the sheet feed unit 11, a proximal end portion of a sheet feed arm 6*a* for feeding the recording sheet P from the sheet feed cassette 3 is fixed to the housing 2 such that the sheet feed arm 6*a* is upwardly and downwardly pivotable. A sheet feed roller 6*b*, which is provided at a distal end portion of the sheet feed arm 6*a*, receives a rotational driving force transmitted from an LF (conveyance) motor 54 (see FIG. 4) through a gear transmission mechanism 6*c* provided in the sheet feed arm 6*a*.

The recording sheets P stacked in the sheet feed cassette 3 are conveyed while being separated sheet by sheet by the sheet feed roller 6*b* and the above-described elastic separation pad of the slant separation plate 8.

The recording sheet P separated so as to move forward along the sheet feed direction (in the direction of arrow A) is fed through a feed path 9, including a laterally open U-shaped path formed between a first conveying path member 53 and a second conveying path member 52 to the recording unit 7 provided above (in an upper position of) the sheet feed cassette 4. The recording unit 7 functions as a so-called printer (an image forming apparatus).

Figure 3A:
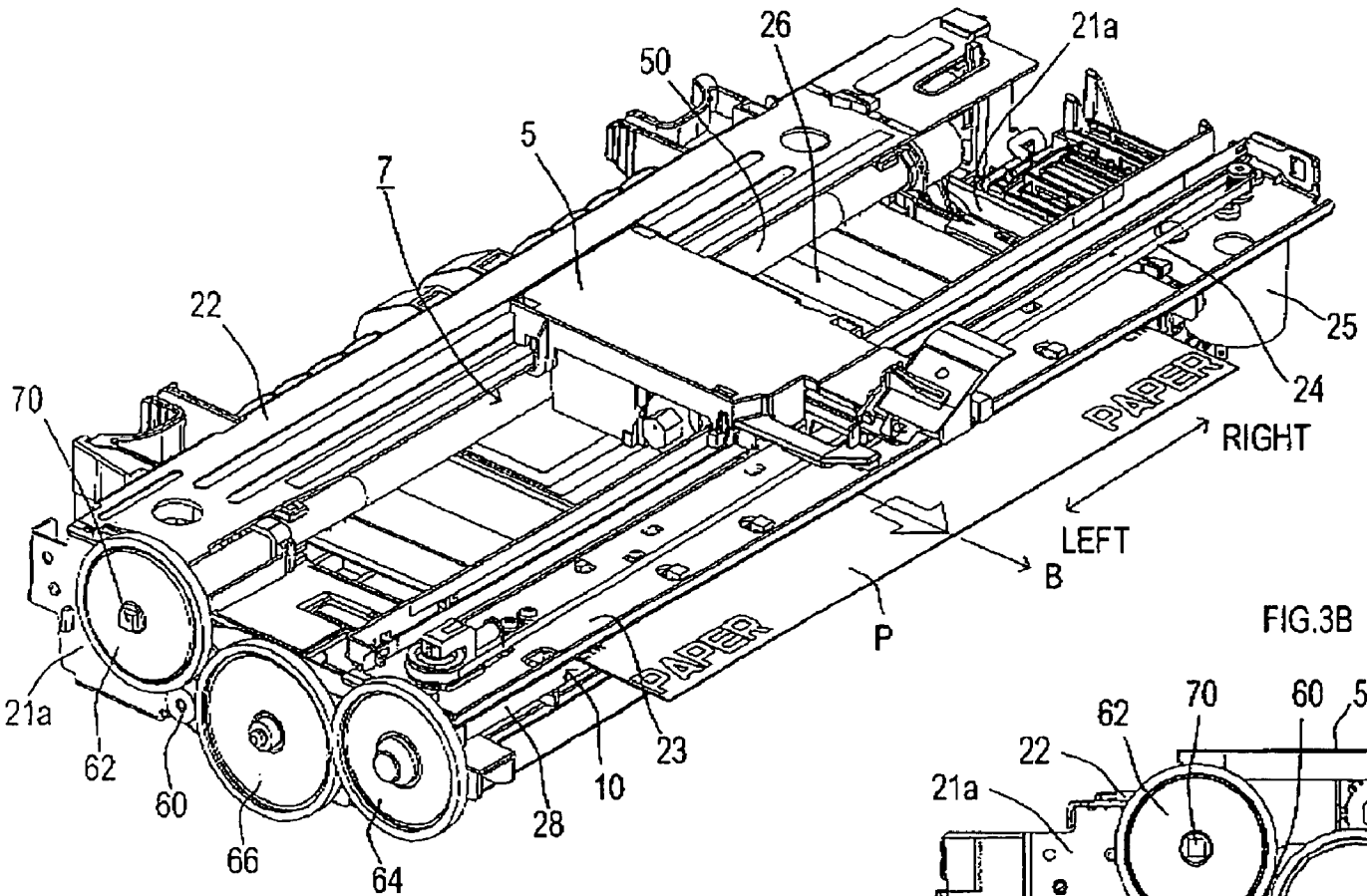
FIG. 3A is a perspective view showing a structure of a recording unit of the multi-function device.
Figure 3B:
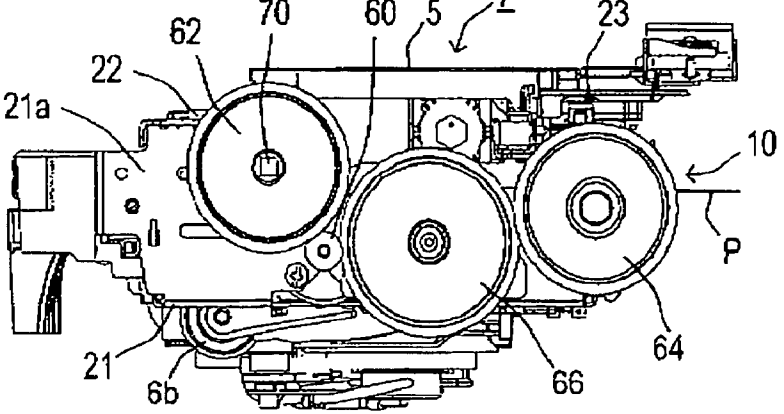
FIG. 3B is a side elevation view showing the structure of the recording unit of the multi-function device.

As shown in FIG. 3, the recording unit 7 is provided within a main frame 21, a first guide member 22 and a second guide member 23. The main frame 21 has a top-open box-shaped configuration. The first guide member 22 and the second guide member 23 are elongated plate like members which are supported by a pair of right and left side panels 21*a* of the main frame 21 and extend in a right and left direction (in the main scanning direction). The recording unit 7 includes a recording head 4 (see FIG. 2) of inkjet type that discharges ink from an undersurface thereof to record an image on the recording sheet P and a carriage 5 on which the recording head 4 is mounted.

The carriage 5 is mounted in a bridging manner between the first guide member 22 on an upstream side in a sheet discharging direction (in a direction of arrow B) and the second guide member 23 on a downstream side, and is slidably held by the first guide member 22 and the second guide member 23. The carriage 5 is reciprocable in the right and left direction. On an upper surface of the second guide member 23, a timing belt 24 is provided to extend in the main scanning direction (in the right and left direction), in order to reciprocate the carriage 5. A CR motor (carriage motor) 25 for driving the timing belt 24 is fixed on an undersurface of the second guide member 23.

Under the recording head 4 of the carriage 5 in the recording unit 7, a flat plate-like platen 26 extending in the right and left direction and facing the recording head 4 is fixed to the main frame 21 between both the first and second guide members 22 and 23.

On an upstream side of the platen 26 in the sheet discharging direction (in the direction of arrow B), a conveyor roller 50 and a nip roller 51 (see FIG. 2) are disposed. The conveyor roller 50 conveys the recording sheet P toward under the recording head 40. The nip roller 51 is located opposite to and biased toward the conveyor roller 50.

On a downstream side of the platen 26 in the sheet discharging direction (in the direction of arrow B), a sheet discharge roller 28 and a spur roller (not shown) are disposed. The sheet discharge roller 28 is driven so as to convey the recording sheet P which has passed the recording unit 7 toward a sheet discharge portion 10 along the sheet discharging direction (in the direction of arrow B). The spur roller is located opposite to and biased toward the sheet discharge roller 28.

An LF motor 54 (see FIG. 4) is fixed in the main frame 21, and a rotation shaft of the LF motor 54 projects outward from the left side panel 21*a* located on a left side in FIG. 3. A drive gear 60 is fixed to the rotation shaft of the LF motor 54. The drive gear 60 transmits power from the LF motor 54 to the conveyor roller 50, the sheet discharge roller 28 and the sheet feed roller 6*b* (particularly a gear transmission mechanism 6*c* in the sheet feed arm 6*a*).

Rotation shafts of the conveyor roller 50, the sheet discharge roller 28 and the gear transmission mechanism 6*c*, respectively, also project outward from the left side panel 21*a*. Driven gears 62, 64 and 66, each of which is connected to the drive gear 60 directly or through another gear to receive the power from the LF motor 54, are fixed to these rotation shafts, respectively. A gyro sensor 70 is fixed to the rotation shaft of the conveyor roller 50 to detect an angular velocity around the rotation shaft.

Returning to FIG. 2, the recording sheet P after recording in the recording unit 7 is discharged with its recorded surface upward into the sheet discharge portion 10. The sheet discharge portion 10 is disposed above the sheet feed unit 11, and a sheet discharge port 10*a* is opened so as to be integrated with the opening 2*a* in the front portion of the housing 2. The recording sheet P discharged along the sheet discharging direction (in the direction of arrow B) is contained in a stacked manner on a sheet discharge tray 10*b* which is located inside the opening 2*a*.

A not shown ink reservoir portion is provided in a front right end portion inside the housing 2 covered with the image scanner 12. Four ink cartridges containing inks of four colors (black (Bk), cyan (C), magenta (M) and yellow (Y)), respectively, for performing full-color recording are mounted in the ink reservoir portion so as to be attachable and detachable when the image scanner 12 is opened upward.

The ink cartridges and the recording head 4 are connected through four flexible ink supply tubes. The inks contained in the ink cartridges are supplied to the recording head 4 through the respective ink supply tubes.

Figure 4:
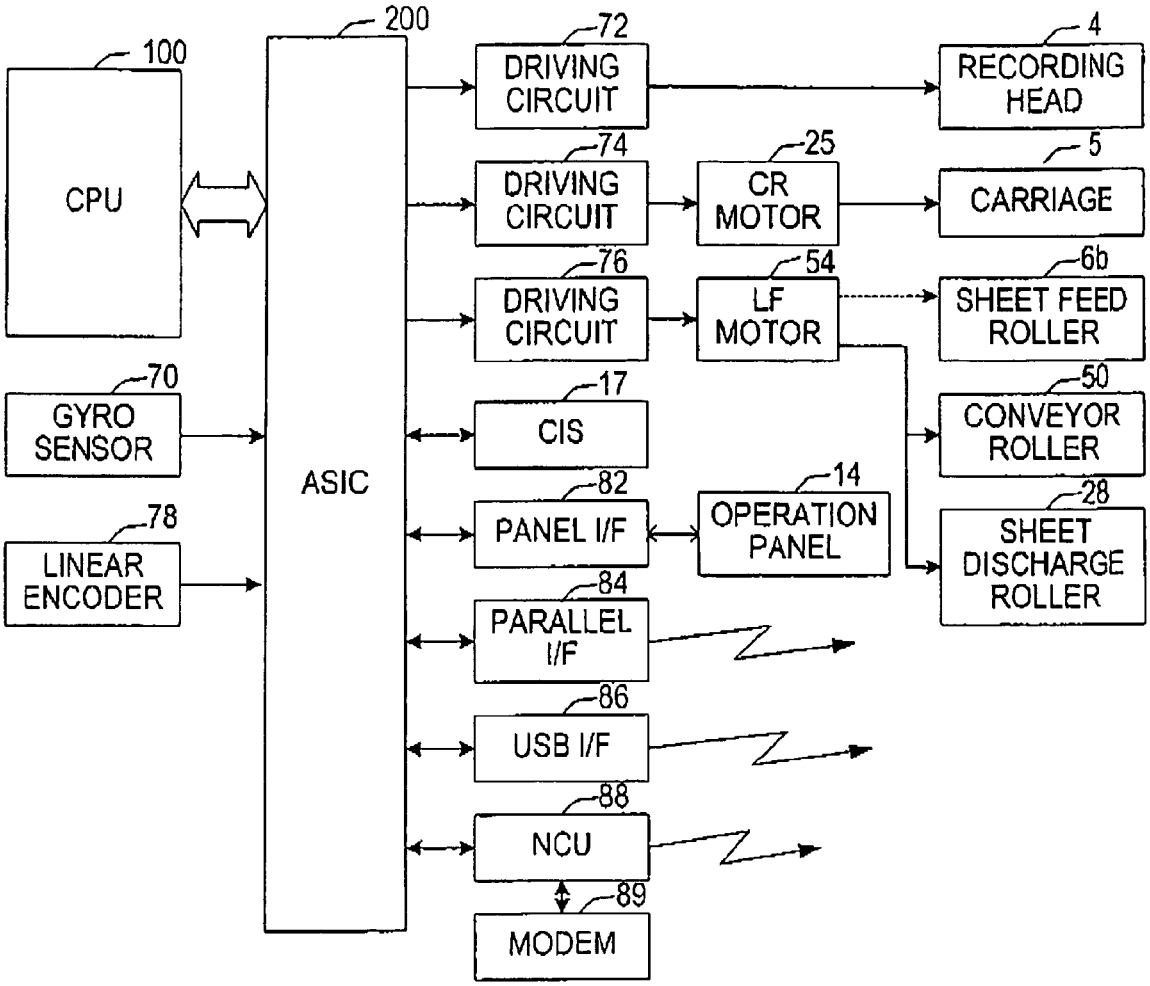
FIG. 4 is a block diagram showing an entire configuration of a control system of the multi-function device.

As shown in FIG. 4, a control system of the multi-function device 1 is constituted mainly by a microcomputer (hereinafter also simply referred to as a "CPU") 100 and an ASIC (Application Specific Integrated Circuit) 200. The microcomputer 100, including a CPU, a ROM and a RAM, totally controls the entire multi-function device 1. The ASIC 200 controls driving of the above various components, such as the LF motor 54, the CR motor 25, the recording head 4, the CIS 17 and the like, in accordance with commands from the CPU 100.

The CIS 17, driving circuits 72, 74 and 76 for the recording head 4, the CR motor 26 and the LF motor 54, respectively, a linear encoder 78 and the gyro sensor 70 are connected to the ASIC 200. The linear encoder 78 detects a position of the carriage 5 which is moved in the main scanning direction due to the rotation of the CR motor 25. The gyro sensor 70 detects the angular velocity of the conveyor roller 50 around the rotation shaft thereof.

A panel interface (panel I/F) 82, a parallel interface (parallel I/F) 84, a USB interface (USB I/F) 86, an NCU (Network Control Unit) 88 and others are also connected to the ASIC 200.

The panel interface 82 is used to obtain information input by a user through the operation buttons 14*a* of the operation panel 14, input the information into the CPU 100, and display various messages and the like on the liquid crystal display (LCD) 14*b* of the operation panel 14 in accordance with display commands from the CPU 100.

The parallel interface 84 or the USB interface 86 is used to communicate with an external device, such as a personal computer, through a parallel cable or a USB cable.

The NCU 88 is used to perform communications through a PSTN (Public Switched Telephone Network). A modem (MODEM) 89 is connected to the NCU 88, in order to demodulate a communication signal input from the PSTN to the NCU 88 and modulate data to be transmitted to an outside source via facsimile transmission or the like into a communication signal.

That is, the printer function, the copier function, the scanner function and the facsimile function can be achieved by the operations of the CPU 100 and the ASIC 200 in the multi-function device 1 of the present embodiment.

An explanation will now be provided in the case of recording an image on the recording sheet P in the printer function, the copier function and the facsimile function.

The CPU 100 first rotationally drives the LF motor 54 in a predetermined direction through the ASIC 200 thereby to rotate the sheet feed roller 6*b* in the sheet feed direction. Thus, the recording sheet P is fed from the sheet feed cassette 3 toward the conveyor roller 50, Then, the CPU 100 rotationally drives the LF motor 54 in a reverse direction each time by a predetermined amount thereby to rotate the conveyor roller 50 and the sheet discharge roller 28 in the sheet feed direction of the recording sheet P by a predetermined amount. Thus, the recording sheet P is moved stepwisely on the platen 26.

When the recording sheet P temporarily stops on the platen 26 during the stepwise movement, the CPU 100 makes the recording head 4 discharge ink based on recording data while driving the CR motor 25 to move the carriage 5 in the main scanning direction.

As a result, an image for one scanning operation is formed on the recording sheet P. The CPU 100 repeatedly performs a sequence of control, such as driving the LF motor 54 (movement of the recording sheet P), driving the CR motor 25 (movement of the carriage 5) and driving the recording head 4, through the ASIC 200, thereby to form an image over an entire area of the recording sheet P.

When the recording sheet P is conveyed from the sheet feed cassette 3 to the recording unit 7, the CPU 100 switches a rotation direction of the LF motor 54. This is for the following reason.

In the present embodiment, the sheet feed roller 6*b*, the conveyor roller 50 and the sheet discharge roller 28 rotate all together when a rotational driving force is transmitted from the LF motor 54. While the sheet feed roller 6*b* rotates in a direction in which the recording sheet P is fed from the sheet feed cassette 3, the conveyor roller 50 and the sheet discharge roller 28 are rotated in a reverse direction to a direction of conveying the recording sheet P toward a sheet discharge side (hereinafter referred to as a "conveyance rotation direction"). This makes the front edge of the recording sheet P fed from the sheet feed cassette 3 abut the conveyor roller 50 and the nip roller 61, so that an oblique movement of the recording sheet P may be corrected. Subsequently, the rotation direction of the LF motor 54 is switched so as to rotate the conveyor roller 50 and the sheet discharge roller 28 in the conveyance rotation direction, and thereby the recording sheet P is conveyed from the recording unit 7 to the sheet discharge portion 10.

To enable conveyance of the recording sheet P as described above, a rotational driving force transmission path from the LF motor 54 to the sheet feed roller 6*b* is configured to allow switching between two states, i.e., a transmission state for transmitting the rotational driving force and a non-transmission state for not transmitting the rotational driving force. The rotational driving force is transmitted from the LF motor 54 to the sheet feed roller 6*b* only when a sheet feed operation of the recording sheet P from the sheet feed cassette 3 is to be performed.

Figure 5:
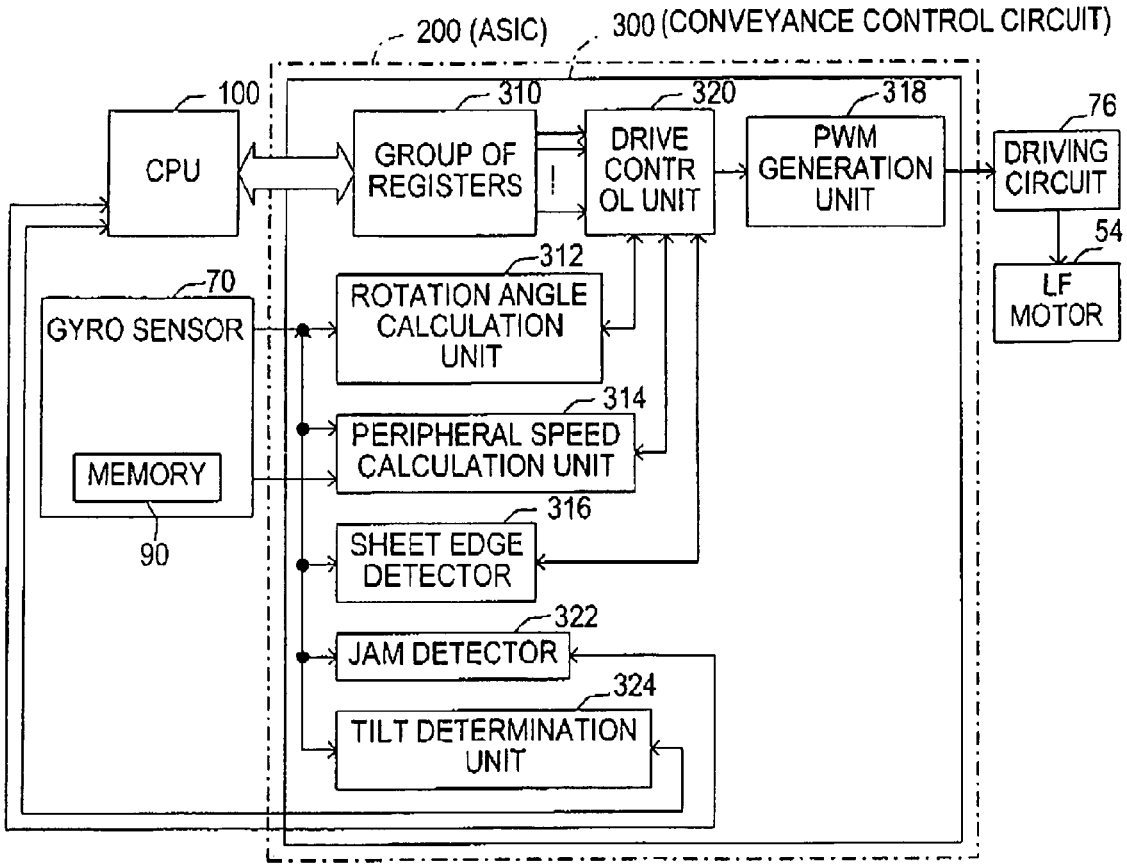
FIG. 5 is a block diagram showing a configuration of a conveyance control circuit incorporated in an ASIC of the multi-function device.

FIG. 5 shows a configuration of a conveyance control circuit 300 incorporated in the ASIC 200 in order to enable conveyance of the recording sheet P as above.

The conveyance control circuit 300 is designed to control driving of the LF motor 54 in response to a command from the CPU 100. The conveyance control circuit 300 generates a PWM signal for controlling a rotation speed, the rotation direction, and the like of the LF motor 54, and outputs the PWM signal to the driving circuit 76, thereby to drive the LF motor 54 through the driving circuit 76.

To enable the above control, the conveyance control circuit 300 includes a group of registers 310, a rotation angle calculation unit 312, a peripheral speed calculation unit 314, a sheet edge detector 316, a drive control unit 320, a PWM generation unit 318.

The group of registers 310 store a variety of parameters required to control the LF motor 54 by the CPU 100. The rotation angle calculation unit 312 calculates a rotation angle of the conveyor roller 50 by integrating a detected signal (with an angular velocity ω) from the gyro sensor 70 provided to the rotation shaft of the conveyor roller 50. The peripheral speed calculation unit 314 calculates a peripheral speed of the conveyor roller 50 based on the detected signal (with the angular velocity ω) from the gyro sensor 70. The sheet edge detector 316 detects that the front edge of the recording sheet P has reached a holding position between the conveyor roller 50 and the nip roller 51 from a change in the detected signal (with the angular velocity ω) from the gyro sensor 70. The drive control unit 320 generates a command signal to drive the LF motor 54 based on input data from these components. The PWM generation unit 318 generates a PWM signal for performing duty driving of the LF motor 54 in accordance with the command signal from the drive control unit 320.

The parameters to be set in the group of registers 310 by the CPU 100 are, for example, a variety of control gains (a proportion gain, an integration gain, and the like) necessary to perform feed back control (FB control) of the rotation speed of the LF motor 54 and a target stopping position (specifically a rotation amount since the driving of the LF motor 54 is started) of the LF motor 54 (and thus the conveyor roller 50). In the drive control unit 320, the command signal to drive the LF motor 54 is generated based on the parameters.

In the present embodiment, a non-volatile memory 90, such as an EEPROM, is incorporated as a storage device in the gyro sensor 70. In the memory 90, an actual measurement value of a radius r (or alternatively a diameter) of the conveyor roller 50, to which the gyro sensor 70 is fixed, is stored.

The peripheral speed calculation unit 314 calculates a peripheral speed V ($V=r\cdot\omega$) of the conveyor roller 50 using the radius r of the conveyor roller 50 stored in the memory 90 and the angular velocity ω detected by the gyro sensor 70.

The sheet edge detector 316 monitors a state of change in the angular velocity ω from a derivative value or the like of the angular velocity ω detected by the gyro sensor 70. The sheet edge detector 316 detects that the front edge of the recording sheet P has reached the holding position between the conveyor roller 50 and the nip roller 61 since the recording sheet P is fed, when the angular velocity ω first declines at a predetermined change rate within a specified range and then starts to incline.

Figure 6A:
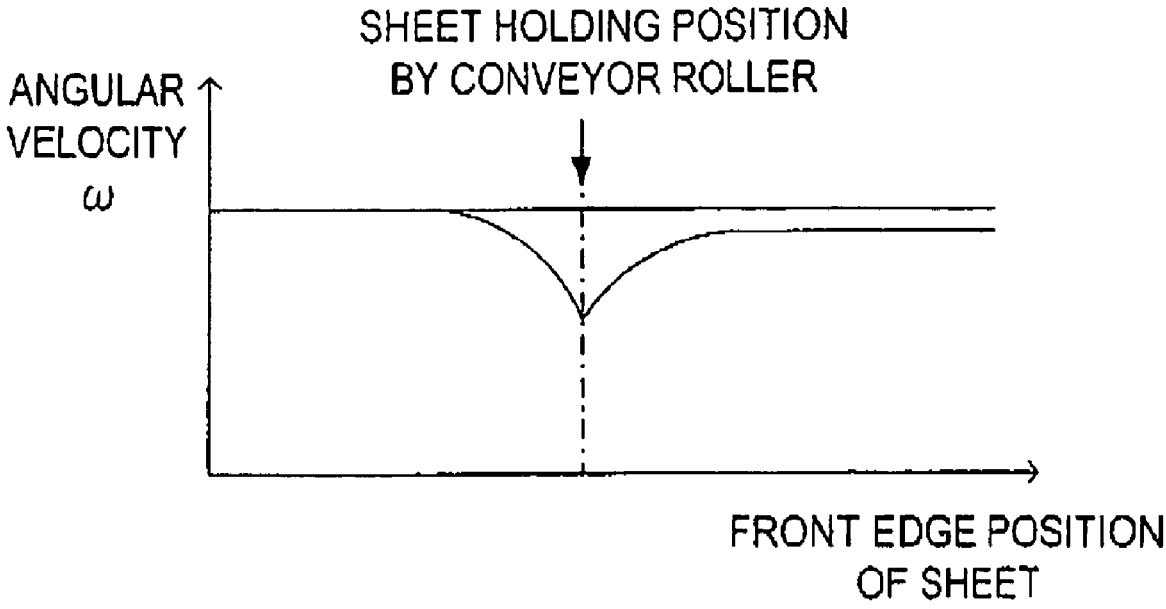
FIG. 6 is an explanatory view showing operations of a sheet edge detection unit and a jam detector in the ASIC.

The above detection can be performed specifically in the following manner. When the recording sheet P is fed by the rotation of the sheet feed roller 6*b*, and the front edge of the recording sheet P reaches the conveyor roller 50 and then the recording sheet P is held between the conveyor roller 50 and the nip roller 51, the angular velocity ω of the conveyor roller 50 around the rotation shaft temporarily declines, as shown in FIG. 6A. The sheet edge detector 316 is designed to detect such a temporary decline in the angular velocity ω thereby to detect a front edge position of the recording sheet P.

The conveyance control circuit 300 also includes a jam detector 322 and a tilt determination unit 324. The jam detector 322 detects a sheet jam based on a detection signal (with the angular velocity ω) from the gyro sensor 70 while the LF motor 54 is driven. The tilt determination unit 324 determines a tilt of the multi-function device 1 based on a detection signal (with the angular velocity ω) from the gyro sensor 70 while the LF motor 54 is not driven.

A detection signal from the jam detector 322 and a determination signal from the tilt determination unit 324 are input to the CPU 100. When a jam is detected by the jam detector 322, the CPU 100 makes the ASIC 200 stop an image forming operation, and makes the operation panel 14 display an error message. When a tilt of the multi-function device 1 is detected by the tilt determination unit 324, the CPU 100 makes an alarm device (not shown), which is incorporated in the operation panel 14, generate an alarm sound in case of leakage of ink in the above described ink cartridges.

The jam detector 322 detects a jam when the angular velocity ω) detected by the gyro sensor 70 becomes lower than a predetermined jam determination value ωj for jam determination while the conveyor roller 50 is driven.

Figure 6B:
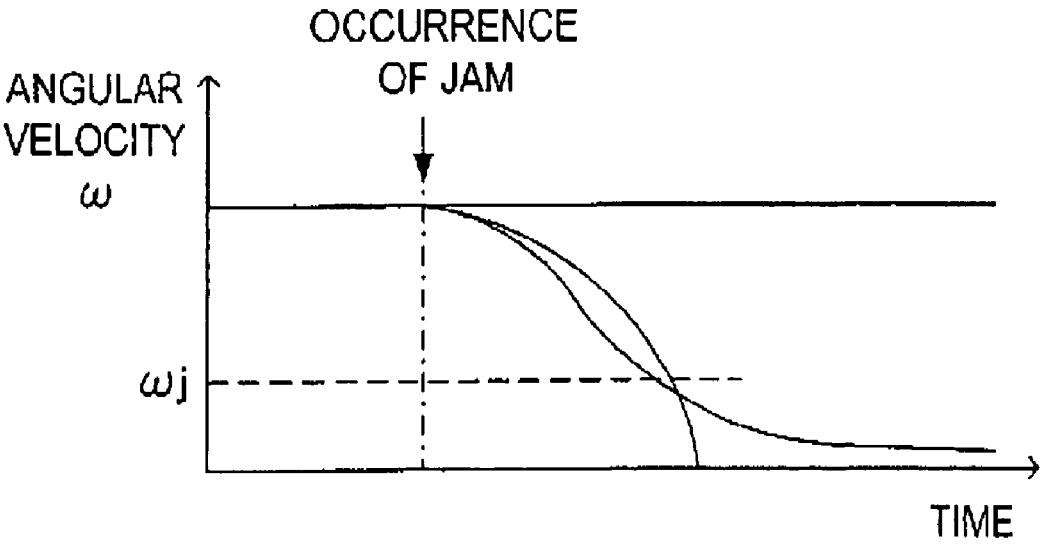

When a jam occurs during the conveyance of the recording sheet P, a load exerted on the conveyor roller 50 is increased, as shown in FIG. 6B, and thereby the angular velocity ω detected by the gyro sensor 70 considerably declines. Accordingly, the jam detector 322 is designed to detect a jam based on such a decline in the angular velocity ω.

The tilt determination unit 324 determines that the multi-function device 1 is considerably tilted when the angular velocity ω detected by the gyro sensor 70 exceeds a predetermined tilt determination value ωi while the conveyor roller 50 is stopped. This can be achieved because when the multi-function device 1 is tilted due to, for example, a change of installation site and an angular velocity around an axis parallel with the rotation shaft of the conveyor roller 50 is generated in the multi-function device 1, a signal corresponding to the angular velocity is output from the gyro sensor 70.

In the multi-function device 1 in the present embodiment, as described above, the rotation angle and the peripheral speed of the conveyor roller 50 necessary for performing conveyance control of the recording sheet P are calculated based on the detection signal (with the angular velocity ω) from the gyro sensor 70, which is fixed to the rotation shaft of the conveyor roller 50. The driving of the conveyor roller 50 may be controlled using the calculated rotation angle and peripheral speed.

Accordingly, in the multi-function device 1 of the present invention, to increase operating speeds of the rotation angle calculation unit 312 and the peripheral speed calculation unit 314 used for calculating the rotation angle and the peripheral speed will lead to improved resolutions of the rotation angle and the peripheral speed as calculation results. It may, therefore, be possible to achieve an improved control accuracy of the conveyance amount or the conveyance position of the recording sheet P, compared with a conventional apparatus using a rotary encoder for detection of these parameters.

It may also be possible to downsize the multi-function device 1 since a size of the gyro sensor 70 needs not be increased to achieve an improved resolution of detectable rotation angles. It may further be possible to achieve an improved control reliability since the gyro sensor 70 is unlikely to be affected by fouling by dust or the like as a rotary encoder.

In the multi-function device 1 in the present embodiment, the front edge position and a jam of the recording sheet P are detected based on changes in the angular velocity ω detected by the gyro sensor 70. Accordingly, there is no need to provide a separate regist sensor for detecting the front edge position of the recording sheet P or a separate sensor for detecting a jam of the recording sheet P. It may, therefore, be possible to reduce a number of components of the multi-function device 1, and thus to achieve downsizing and a lower manufacturing cost, according to the present embodiment.

The front edge position of the recording sheet P is detected when the recording sheet P is actually held between the conveyor roller 50 and the nip roller 51 instead of when the front edge of the recording sheet P passes the regist sensor as in a conventional conveying apparatus. It may, therefore, be possible to detect a conveyance start timing of the recording sheet P by the conveyor roller 50 accurately, and thus to achieve an improved control accuracy.

In the same manner, a rear edge of the recording sheet P may be detected when the recording sheet P comes out of the conveyor roller 50 and the nip roller 51. It may, therefore, be possible to accurately detect a conveyance end timing of the recording sheet P by the conveyor roller 50.

Further, in the multi-function device 1 in the present embodiment, the gyro sensor 70 is used not only for detecting a rotation of the conveyor roller 50, but also for detecting a tilt of the multi-function device 1 itself. When a tilt of the multi-function device 1 is detected by the tilt determination unit 324, the tilt is notified. Accordingly, even when the multi-function device 1 is significantly tilted due to, for example, a change of installation site, the tilt is promptly notified thereby to urge the user to restore a normal posture of the multi-function device 1. It may, therefore, be possible to prevent leakage of ink in the ink cartridge due to the tilt of the multi-function device 1, according to the present embodiment.

In a mass-produced conveying apparatus, there are variations in diameter of a conveyor roller to be used for conveying a conveyance object. As a result, a conveyance amount of the conveyance object per rotation of the conveyor roller differs in each conveyor roller. Accordingly, in a conventional conveying apparatus, an experimentally calculated correction value for correcting a conveyance amount (a control amount) of a conveyance object in accordance with a rotation of a conveyor roller is recorded in a drive control system of the conveyor roller before shipment of the conveying apparatus. When the conveyor roller is actually rotationally driven to convey the conveyance object, a target conveyance amount (a control amount) of the conveyance object is corrected by the correction value.

However, this leads to the following problem: To determine the correction value, it is required to actually operate the conveying apparatus so as to convey the conveyance object and calculate a deviation of a conveyance amount from a predetermined value. Accordingly, a calibrating operation before shipment is troublesome and this will cause an increased cost of the conveying apparatus.

According to the present embodiment, the diameter of the conveyor roller 50 is stored in the memory 90, the peripheral speed of the conveyor roller 50 is calculated based on the angular velocity detected by the gyro sensor 70 and the diameter of the conveyor roller 50 stored in the memory 90. Then, the conveyance speed and the conveyance amount of the recording sheet P can be controlled accurately based on the calculated peripheral speed.

In addition, since it is only necessary to measure the diameter of the conveyor roller 50 and store the same in the memory 90, a calibrating operation before shipment will be extremely easy and this may lead to a reduced cost of the conveying apparatus.

Although one embodiment of the present invention has been described as above, the present invention should not be limited to the specific embodiment, but may be embodied in various forms without departing from the gist of the present invention.

Such an example is described below. In the above embodiment, the angular velocity ω detected by the gyro sensor 70 is used for calculation of the rotation angle or the peripheral speed of the conveyor roller 50. However, the gyro sensor 70 may detect not only the angular velocity generated by the rotation of the conveyor roller 50, but also an angular velocity caused by a main body of the multi-function device 1. Accordingly, when the main body of the multi-function device 1 oscillates while the recording sheet P is conveyed, an oscillation component is added to the angular velocity ω to be detected by the gyro sensor 70.

Figure 7A:
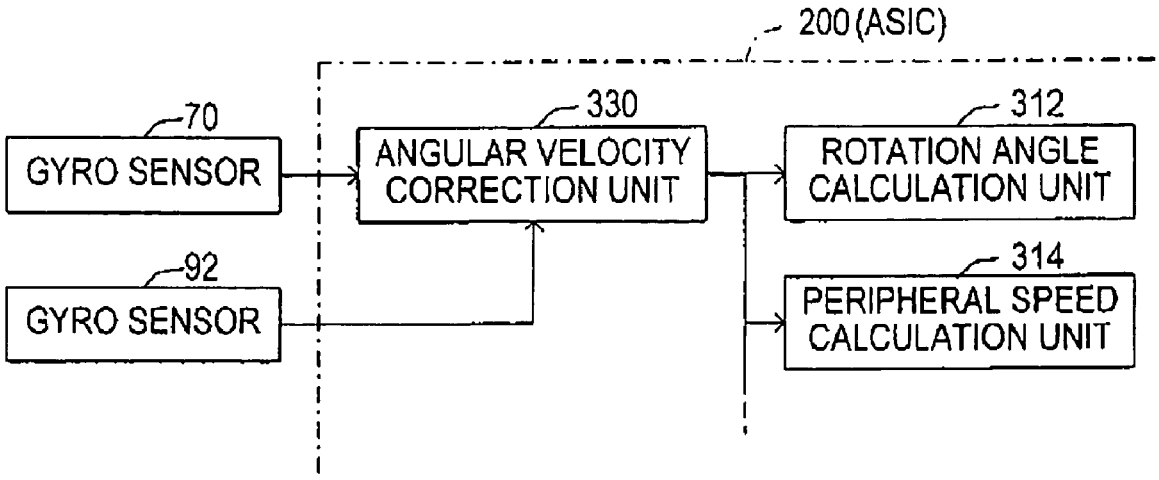
FIGS. 7A and 7B are explanatory views showing modifications of the multi-function device.

In this case, a gyro sensor 92, which detects an angular velocity around an axis parallel with the rotation shaft of the conveyor roller 50, may be provided to a portion which receives the same oscillation from the main body of the multi-function device 1 as the gyro sensor 70. Specifically, the portion may be the main frame 21 or the side panel 21*a* to which the conveyor roller 50 is fixed. Also, an angular velocity correction unit 330 may be provided to the ASIC 200 as shown in FIG. 7A. In the angular velocity correction unit 330, an angular velocity ωr (ωr=ω−ωa) may be calculated by subtracting an angular velocity component ωa detected by the gyro sensor 92 from the angular velocity ω detected by the gyro sensor 70 provided to the conveyor roller 50. Subsequently, the angular velocity ωr calculated by the angular velocity correction unit 330 may be input into the rotation angle calculation unit 312 or the peripheral speed calculation unit 314.

According to the present example, it may be possible to accurately detect the rotation angle and the peripheral speed of the conveyor roller 50, the sheet edge of the recording sheet P, a jam, and others without being affected by the angular velocity caused by the main body of the multi-function device 1. This may lead to an improved control accuracy of the conveyance of the recording sheet P and an improved reliability of the multi-function device 1.

Figure 7B:
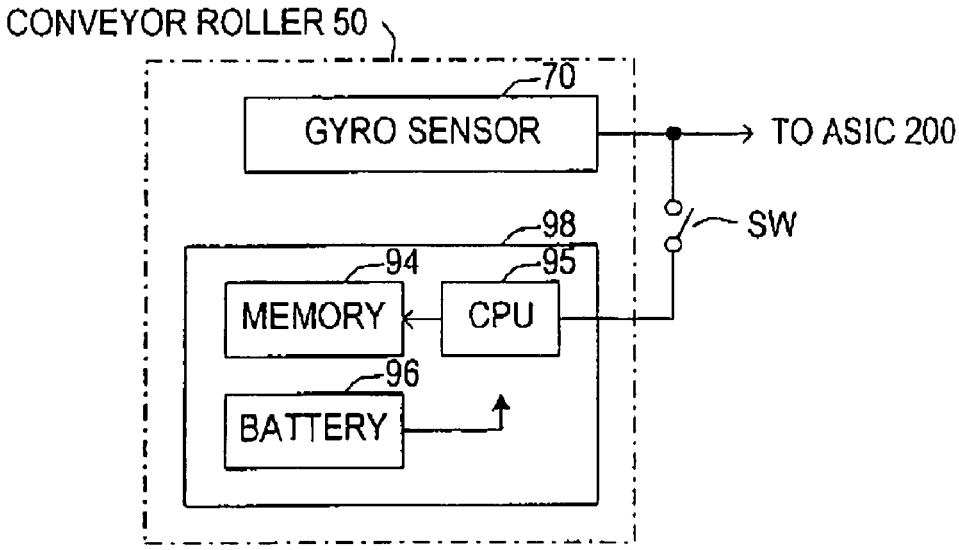

In another example, an angular velocity storage unit 98 may be provided to the conveyor roller 50 in addition to the gyro sensor 70, as shown in FIG. 7B. The angular velocity storage unit 98 may periodically perform sampling of an angular velocity applied to the multi-function device 1, for example, during transportation after shipment of the multi-function device 1, and store sampled values.

More specifically, the angular velocity storage unit 98 includes a memory 94, a one-chip microcomputer (CPU) 95 and a battery 96. The memory 94 serves as another storage device to store a history of sampled angular velocities, The one-chip microcomputer (CPU) 95 periodically performs sampling of the angular velocity from the gyro sensor 70 and writes the sampled values to the memory 94. The battery 96 supplies power to the memory 94 and the one-chip microcomputer (CPU) 95. The gyro sensor 70 and the angular velocity storage unit 98 are connected through a switch SW capable of being manually switched between on and off states. In the on state of the switch SW, power is supplied from the angular velocity storage unit 98 to the gyro sensor 70, and the angular velocity storage unit 98 retrieves a detected signal from the gyro sensor 70.

In this case, the switch SW is turned on at the time of factory shipment of the multi-function device 1 and is turned off at the time of first use of the multi-function device 1. As a result, the angular velocity detected by the gyro sensor 70 after shipment of the multi-function device 1 is periodically stored in the memory 94. If any trouble is found, for example, when the multi-function device 1 is taken from a package for transportation or when power is turned on to make the multi-function device 1 operate, inspection of a cause of the trouble may be facilitated based on time-series data of the angular velocity stored in the memory 94.

While the gyro sensor 70 is fixed to the rotation shaft of the conveyor roller 50 in the above-described embodiment, the gyro sensor 70 needs not necessarily be fixed to the rotation shaft of the conveyor roller 50, as long as the angular velocity caused by the rotation of the conveyor roller 50 can be detected. For example, the gyro sensor 70 may be fixed to a side wall of the driven gear 62, which is fixed to the rotation shaft of the conveyor roller 50, so as to detect an angular velocity around an axis parallel with the rotation shaft of the conveyor roller 50. Alternatively, the gyro sensor 70 may be fixed to a rotation shaft of the LF motor 54, which drives the conveyor roller 50, or a side wall of the drive gear 60, which is fixed to the rotation shaft of the LF motor 54, so as to detect an angular velocity around an axis parallel with the rotation shaft of the conveyor roller 50.

In the above-described embodiment, the present invention is applied to the drive control of the LF motor 54 in a multi-function device including the recording unit 7 of inkjet type. However, the present invention may be applied to any conveying apparatus for conveying a conveyance object, such as a recording sheet, by rotationally driving a conveyor roller by a motor in respect of scattering of paper powder. Furthermore, the present invention may be advantageous when applied to an image recording apparatus of electronic photograph type, such as a laser printer in which fine toner powder is likely to be scattered.

What is claimed is:

1. A conveying apparatus comprising:

a conveyor roller that conveys a conveyance object by a rotation thereof;

an angular velocity detection device that is provided to one of the conveyor roller and a rotating portion rotating with the conveyor roller; and a rotation angle calculation device that calculates a rotation angle of the conveyor roller based on an angular velocity detected by the angular velocity detection device.

2. The conveying apparatus according to claim 1, further comprising:

a conveyance operation determination device that monitors a state of change in the angular velocity while the conveyor roller is driven, and determines a start of conveyance and an end of conveyance of the conveyance object by the conveyor roller when the angular velocity temporarily increases and decreases, respectively.

3. The conveying apparatus according to claim 1, further comprising:

a conveyance trouble determination device that determines a trouble in a conveyance system for the conveyance object when the angular velocity becomes lower than a predetermined trouble determination value while the conveyor roller is driven.

4. The conveying apparatus according to claim 1, further comprising:

a tilt determination device that determines that the conveying apparatus is tilted when the angular velocity exceeds a predetermined tilt determination value while the conveyor roller is stopped.

5. The conveying apparatus according to claim 1, further comprising:

a storage device that stores a radius of the conveyor roller; and a peripheral speed calculation device that calculates a peripheral speed of the conveyor roller based on the angular velocity detected by the angular velocity detection device and the radius of the conveyor roller stored in the storage device;

wherein at least the storage device is incorporated into the angular velocity detection device.

6. The conveying apparatus according to claim 1, further comprising:

an otheran gular velocity detection device that is fixed to a main body of the conveying apparatus rotatably holding the conveyor roller such that an angular velocity detection axis is parallel with the rotation shaft of the conveyor roller; and a correction device that corrects one of the angular velocity detected by the angular velocity detection device provided to the conveyor roller or the rotating portion, and the rotation angle of the conveyor roller calculated by the rotation angle calculation device based on an angular velocity detected by the another angular velocity detection device.

7. The conveying apparatus according to claim 1, further comprising:

an angular velocity storing device that periodically performs sampling of the angular velocity detected by the angular velocity detection device while an operation of the conveying apparatus is stopped, and stores sampling results in an other storage device.

8. The conveying apparatus according to claim 1, further comprising:

a drive unit that rotationally drives the conveyor roller; and a control device that controls the drive unit based on the angular velocity detected by the angular velocity detection device thereby to control a rotation of the conveyor roller.

9. The conveying apparatus according to claim 1;

wherein the angular velocity detection device detects an angular velocity about a rotation axis of either the conveyor roller or the rotating portion.

10. The conveying apparatus according to claim 1;

wherein the angular velocity detection device includes a gyro sensor.

11. The conveying apparatus according to claim 10;

wherein the gyro sensor is provided at a rotation shaft of the conveyor roller or on a side wall of the rotating portion.

12. An image forming apparatus comprising:

the conveying apparatus according to claim 1.

* * * * *